United States Patent [19]

Vignes

[11] 4,174,233

[45] Nov. 13, 1979

[54] EXPANSION PROCESS FOR REDUCING THE STRESSES IN A SEAMLESS METAL TUBE

[75] Inventor: Alain Vignes, Paris, France

[73] Assignee: Societe Franceo-Americaine de Constructions Atomiques-Framatome, Courbevoie, France

[21] Appl. No.: 835,853

[22] Filed: Sep. 22, 1977

[30] Foreign Application Priority Data

Oct. 1, 1976 [FR] France ..... 76 29655

[51] Int. Cl.[2] ..... C23F 7/00

[52] U.S. Cl. ..... 148/4; 29/421 R; 72/61; 148/131

[58] Field of Search ..... 148/4, 13, 131, 127, 148/130; 228/104, 119, 203, 184; 72/700, 56, 701, 54, 60, 61, 62, 63; 29/421 R, 497, 33 T

[56] References Cited

U.S. PATENT DOCUMENTS

| | | | |
|---|---|---|---|
| 3,343,249 | 9/1967 | Breit, Jr. et al. | 29/421 R |
| 3,456,831 | 7/1969 | Johansson | 228/203 |
| 3,535,484 | 10/1970 | Snow et al. | 228/104 |
| 3,817,796 | 6/1974 | Kramer | 148/131 |
| 3,979,231 | 9/1976 | Gondo et al. | 148/153 |

OTHER PUBLICATIONS

Berge et al., "Residual Stresses in Bent Tubes for Nuclear Steam Generators" *CORROSION-NACE,* vol. 32, No. 9, Sep. 1976, pp. 357-364.

Schenk, "Investigation of Tube Failures in Inconel 600 Steam Generator Tubing at KWO Obrigheim," *MATERIALS PERFORMANCE,* Mar. 1976, pp. 25-33.

Van Rooyen, "Review of Stress Corrosion Cracking of Inconel 600," *CORRISION-NACE,* vol. 31, No. 9, Sep. 1975, pp. 327-337.

*Primary Examiner*—L. Dewayne Rutledge
*Assistant Examiner*—Peter K. Skiff
*Attorney, Agent, or Firm*—Haseltine, Lake & Waters

[57] ABSTRACT

A process for reducing the residual stresses in a seamless metal tube which has undergone a straightening operation comprising subjecting the tube to an internal pressure of between 0.8 Pc and 1.0 Pc for a period of at least 3 minutes, while maintaining the temperature of the tube at or close to ambient temperature, Pc being the critical pressure beyond which the tube will undergo plastic deformation.

4 Claims, No Drawings

EXPANSION PROCESS FOR REDUCING THE STRESSES IN A SEAMLESS METAL TUBE

FIELD OF THE INVENTION

The invention relates to a process for reducing stresses in seamless tubes which have undergone a straightening operation.

BACKGROUND

Seamless tubes intended for heat exchangers or for steam generators undergo straightening and bending operations before assembly.

In particular, tubes made of the nickel alloy Inconel 600, used in the steam generators of nuclear power stations, undergo these operations at the end of the manufacturing cycle, just before the hydrostatic test during which water under pressure is fed into the tube, this test being intended to separate the tubes which fail.

The final operations of straightening and bending these tubes introduce longitudinal and circumferential residual stresses into the tubes. Where these residual stresses are tensile stresses, they are superimposed on the stresses applied to the tubes in operation (compressive stresses, bending stresses and thermal stresses.

The presence of these residual stresses, superimposed on the stresses which the tube undergoes in operation, is detrimental to the corrosion stress cracking resistance of these tubes. In fact, as regards corrosion stress cracking, it is the highest total principal stresses, whether longitudinal or circumferential, which determine the direction of cracking.

It is thus necessary to remove, from the tubes of steam generators, the residual stresses originating from the mechanical treatments which these tubes have undergone at the end of the manufacturing cycle.

Thermal stress release processes for removing these residual stresses have been proposed, which consist of keeping the tubes at a temperature of about 700° C. for a defined time. The operation of these heat treatments however requires the construction of very large ovens into which the tubes, which are themselves of large size, can be introduced, and this greatly increases the cost of the installations required for the manufacture of steam generator units for nuclear power stations.

On the other hand, mechanical stress release processes are known, which are applied to semi-finished goods such as bars or sheets to remove the residual stresses originating from the forming process. These mechanical treatments introduce permanent deformations of large amplitude into the semi-finished goods thus treated, and can therefore not be used in the case of finished articles such as steam generator tubes, where rigorously precise dimensions are required.

Mechanical stress release treatments applied to welded articles to remove the residual stresses in the vicinity of the zone affected by the welding process are also known. In particular, a process has been proposed for the stress release of very thick fabricated vessels by applying an internal hydrostatic pressure slightly greater than the test pressure of the vessels. Because the welded zone has a lower strength it is not possible to use a high internal pressure see U.S. Pat. No. 3,343,249 and "Reduction of Residual Sresses in Welded Joints . . . ;" Etingov and Mikhaila; Svar, 1972 No. 12 pp 38–40; consequently the residual stresses remain at a high level after the internal pressure treatment, so that this treatment is of very mediocre efficiency.

In the case of Inconel tubes for steam generators of nuclear power stations, the level of residual stresses must be sufficiently low to avoid the corrosion stress cracking phenomenon when these tubes are put into service, and it is insufficient to put these tubes under hydrostatic pressure if the pressure remains near the test pressure of the tube.

SUMMARY OF THE INVENTION

It is an object of the invention to provide a process for the stress release of a seamless tube which has been subjected to a straightening operation, which process makes it possible to lower the level of residual stresses in the tube to a sufficiently low value that when the tube is put into operation the residual stresses will not significantly increase the corrosion stress cracking tendency of the tube.

According to the invention there is provided a process for reducing the stresses in a seamless metal tube which has undergone a straightening operation, the process comprising, while maintaining said tube at a temperature close to ambient temperature, subjecting said tube for a period of at least 3 minutes, to an internal pressure of between 0.8 Pc and 1.0 Pc, Pc being the critical pressure beyond which said tube undergoes a plastic deformation over its entire thickness.

An embodiment of the process in accordance with the invention will now be described, by way of example only, for the case of Inconel tubes intended for steam generators of a nuclear power station.

These tubes are bent to provide each tube with two branches, the length of the branches being 10 meters, the branches being of equal length and being separated by a varying distance which determines the radius of the tube bend. These tubes have an external diameter of about 22.22 mm and a thickness of about 1.27 mm.

The bent tubes are shaped from a seamless tube 20 meters long by straightening the tube and then bending it so as to obtain two branches of equal length.

The properties of a set of tubes intended for the mechanical stress release treatment by hydraulic testing has been summarized in Table I below:

For each of these Inconel tubes, the elastic limit is determined to 0.2%, with sufficient precision for the subsequent determination of the critical plastic deformation pressure of the tube over its entire thickness.

This critical pressure Pc is determined from the elastic limit of the tube by the following equation, obtained with the Tresca criterion $$Pc = R0.2\mathrm{Log}(r1/rO)$$

where R 0.2 is the elastic limit, $r1$ is the external radius of the tube, and $rO$ is the internal radius of the tube The values of the critical pressure obtained have been recorded in Table I.

In order to carry out an embodiment of the stress release process according to the invention, a hydrostatic test bench, as commonly used for testing generator tubes, is employed, the water under pressure being passed into the tubes by means of this test rig.

The hydrostatic test pressure usually employed for the Inconel 600 tubes is 218 bars.

The pressure Pc used for the mechanical stress release of the tubes by maintaining an internal pressure in the tube, located on the hydrostatic test rig, have been recorded in Table I.

It will be seen that the mechanical stress release pressures used are very much higher than the hydrostatic test pressure and that they are all within the range of 80 to 100% of the critical pressure determined from the equation deduced from the Tresca criterion.

Water under this high pressure is kept in the tubes, mounted on the hydrostatic test rig, for a period equal to or greater than 3 minutes. After having brought the tubes back to normal pressure and having dismantled them from the hydrostatic test bench, various measurements are carried out on these tubes to determine the deformations undergone and to measure the circumferential residual stresses in these tubes. In particular, the diameters of the straight parts of the bent tubes are determined before and after the stress release process and the ovalization of these tubes is measured.

Table 1

CHARACTERISTICS OF THE TUBES SUBJECTED TO THE HYDRAULIC TEST

| Tubes | Distance between the branches before testing mm | Variation in distance between the branches after testing mm | Pressure Pe bar | $r_0$ mm | $r_1$ mm | R 0.2 hbar | Pc bar | Pe/Pc |
|---|---|---|---|---|---|---|---|---|
| 1 | 111.2 | 0.56 | 400 | 9.83 | 11.12 | 34.8 | 430 | 0.93 |
| 2 | 111.2 | 0.77 | 448 | | 11.12 | 37.3 | | |
| 3 | 285.9 | 0.9 | 340 | 9.80 | 11.16 | 33 | 425 | 0.80 |
| 4 | 288.3 | 2.2 | 460 | 9.82 | 11.125 | 36.3 | 450 | 1.02 |
| 5 | 1152.48 | 2.62 | 280 | | 11.13 | 31.4 | | |
| 6 | 1152.48 | 6.55 | 400 | 9.83 | 11.15 | 34.8 | 438 | 0.913 |
| 7 | 2258.84 | 9.57 | 430 | 9.82 | 11.11 | 37.6 | 463 | 0.928 |
| 8 | 2258.84 | 17.4 | 446 | 9.84 | 11.115 | 37.2 | 453 | 0.984 |
| 9 | 2909.64 | 16 | 430 | | 11.105 | 37.4 | | |

In all the stress release processes carried out, the diameters returned to their initial condition in the straight branches of the bends. This shows clearly that the critical pressure determined by calculation is a valid criterion for defining the pressure range within which there is no permanent deformation of the tube.

The distance between the straight branches of the bends before and after the test is also measured and it can be seen, on referring to Table I, that the variation in the absolute distance between the branches near the bend is the more noticeable, the greater is the initial distance between the branches.

The residual circumferential stresses before and after the stress release process were also determined by two different methods.

One of these methods consists of sawing off a 12 mm length of tube and measuring the variation $\Delta\phi$ of the external diameter $\phi$ of the tube during sawing. The results show that there is a linear relation between the value of the maximum residual circumferential stress and the variation in diameter of the tube during sawing.

The second of these methods is an extensometric method which also makes it possible to determine the residual longitudinal stresses in the tube.

The measurements carried out on all the tubes shown in Table I, in accordance with the test conditions mentioned in this table, show that the longitudinal residual stresses after the stress release process are negligible for all the tubes.

The residual circumferential stresses on the external surface of the tubes, that is to say in the zone where they are at a maximum, are shown in Table II.

Table 2.

RESIDUAL CIRCUMFERENTIAL STRAINS ON THE EXTERNAL SURFACE

| | | | | Before stress release | | | After stress release | | | |
|---|---|---|---|---|---|---|---|---|---|---|
| | | | | Ring method | | Extenso- | Ring method | | Extenso- | |
| Tubes | R 0.2 h bar | pressure Pe | Pe/Pc | maximum value | mean value | metric method | maximum value | mean value | metric method | Calculated |
| 3 | 33 | 340 | 0.80 | 18 | 13.1 | 15.5 | 7.8 | 6.9 | 9.1/7.5 | 10 |
| 6 | 34.8 | 400 | 0.913 | 19.5 | 13.5 | — | 6.5 | 6.5 | | 6.9 |
| 7 | 37.6 | 430 | 0.913 | 18.5 | 12.5 | 12.5 | 7.8 | 5.9 | | 6.8 |
| 1 | 34.8 | 400 | 0.93 | 18.5 | 14.5 | | | 6.5 | 7.5 | 6.3 |
| 8 | 37.2 | 446 | 0.984 | 17 | 13.5 | | 7.8 | 5.9 | 6.2 | 4.7 |
| 4 | 36.3 | 460 | 1.02 | 19 | 14.1 | 13.5 | 8.5 | 6.6 | 8.0 | |

It can be seen, in particular, that the residual circumferential stresses, the mean value of which is of the order of 15 hbars and the maximum value of which is of the order of 18 hbars, as determined before the hydraulic test, are approximately halved after a stress release process of a duration equal to or greater than 3 minutes.

The level of the residual stresses is thus lowered very significantly.

On the basis of experiments it has also been found that the stress release must be carried out under an internal pressure in the tube which is at least equal to 0.8 times the critical pressure, if the reduction in residual stresses is to be sufficient so that the tubes, after the stress release treatment, have sufficient corrosion stress crack resistance under the conditions of use.

It will also be seen that in the case of seamless tubes which have been subjected to a straightening operation, the distribution of the circumferential and longitudinal stresses is such that subjecting the tube to a pressure greater than 0.8 times the critical plastic deformation pressure results in a level of removal of the residual stresses which is much superior to that which would be achieved for a welded vessel or a welded tube or for any other metallic envelope which has undergone a forming process or any treatment which generates residual stresses.

Surprisingly, maintaining a pressure at a high value compared to the value of the pressure used for the conventional hydraulic testing of the tubes results in substantial stress release, of an entirely different order of magnitude from the very limited stress release achieved in the case of fabricated and welded vessels under pressure.

The above described process thus makes it possible to avoid the use of ovens of very large size, which would otherwise be needed as the length of the bent tubes for steam generators of nuclear power stations is of the order of 10 meters, and to use, for the stress release treatment, the hydrostatic pressure test bench which was in any case necessary for testing the tubes.

The tests carried out have also shown that in the case of Inconel tubes having elastic limits of between 33 and 38 hbars, stress release at values of the pressure ranging from 340 to 440 bars give virtually comparable values for the reduction in residual stresses. These values of 340 to 440 bars correspond approximately to internal pressures of between 80 and 100% the critical pressure. It thus appears that the choice of the test pressure is not extremely critical provided it is above 0.8 Pc. In practice, a test pressure of about 400 bars can effectively be laid down for values of the elastic limit of the tubes ranging from 33 to 38 hbars.

We have shown that the critical pressure can be calculated easily from a formula based on the Tresca criterion, but it is also possible to use, for this critical pressure, a value deduced from a formula based on the Von Mises criterion, for example, if this criterion is more applicable to the particular material, or to use an experimentally obtained value.

The invention is not intended to be limited to the embodiment which has just been described but comprises all variants. Thus, the tube can be subjected to pressure using any installation, which may be other than a hydrostatic pressure test bench, and the liquid used can also be different from the water used for the hydrostatic tests. It is also possible to use, in place of water at ambient temperature, a slightly preheated liquid so as to add a thermal effect of stress release under pressure. The invention has been described in connectionn with its application to Inconel 600 tubes but the stress release process is applicable to seamless tubes, which have been subjected to straightening, made from any metallic material whatsoever, for example to heat exchange tubes made from stainless steel. It should be noted that the duration of the treatment required to arrive at optimum conditions for removal of the residual stresses may vary from one material to another but it has been found that a duration equal to or greater than 3 minutes is necessary to achieve a significant reduction in the residual stresses.

Instead of determining, for each tube, the critical pressure which defines the possible limits for the test pressure, it is possible to select, for a series of practically identical tubes, a test pressure which must lie, with a high probability, within the required range if the characteristics of the series of tubes are relatively similar.

Finally, the invention is not only applicable to Inconel tubes or stainless steel tubes for steam generators or heat exchangers, but also to any other seamless metal tube which has undergone a straightening operation, and where it is desired to reduce the level of the residual stresses to a value markedly lower than the value of the residual stresses in the straightened tube, for example to half the initial strains or even to a lower value.

What is claimed is:

1. A process for reducing the longitudinal residue stresses to a negligible amount and the circumferential residual stresses to approximately half their original values in a seamless cold-worked metal tube which has undergone a straightening operation, the process comprising, while maintaining said tube at a temperature close to ambient temperature, subjecting said tube for a period of at least 3 minutes, to an internal pressure of between 0.8 Pc and 1.0 Pc, Pc being the critical pressure beyond which said tube undergoes a plastic deformation over its entire thickness whereby the tube remains substantially undeformed after treatment.

2. A process according to claim 1, wherein the elastic limit of said tube is determined by a mechanical test, said critical pressure Pc being calculated from the equation $Pc = R0.2\mathrm{Log}(r1/rO)$, where R 0.2 is said elastic limit of said tube, $r1$ is the external radius of said tube and $rO$ is the internal radius of said tube.

3. A process according to claim 1, wherein said tube is subjected to said internal pressure by passing water under pressure into said tube.

4. A process according to claim 3, wherein said tube is a bent tube of great length for a steam generator of a nuclear power station, said tube being fixed on a hydrostatic pressure test rig, said internal pressure being in a range between 340 and 440 bars.

* * * * *